United States Patent [19]

Schlage

[11] 3,939,315

[45] Feb. 17, 1976

[54] ELECTRIC SWITCH CONTAINED WITHIN LOCK FRAME AND ACTUATED BY MOVEMENT OF LOCKING BAR

[75] Inventor: Ernest L. Schlage, Burlingame, Calif.

[73] Assignee: Schlage Lock Company, San Francisco, Calif.

[22] Filed: June 10, 1974

[21] Appl. No.: 477,899

[52] U.S. Cl. ..... 200/61.64; 70/DIG. 3; 200/61.67

[51] Int. Cl.[2] ..... H01H 27/00

[58] Field of Search ..... 200/44, 61.62–61.79; 340/274; 70/DIG. 3, DIG. 4, DIG. 30, 147, 239, 241, 243, 248, 250; 292/164

[56] References Cited

UNITED STATES PATENTS

| | | | |
|---|---|---|---|
| 867,220 | 9/1907 | Themke | 200/61.64 |
| 921,168 | 5/1909 | Schlage | 200/61.64 |
| 1,112,316 | 9/1914 | Percival | 200/61.64 |
| 1,579,457 | 4/1926 | Schlage | 292/164 |
| 1,708,138 | 4/1929 | Hildahl | 200/61.64 |
| 2,266,086 | 12/1941 | Schlage | 200/61.68 |
| 2,917,337 | 12/1959 | Schlage | 70/DIG. 3 |
| 3,056,125 | 9/1962 | Harry | 340/274 |
| 3,259,707 | 7/1966 | Eickhoff | 200/61.67 |
| 3,353,383 | 11/1967 | Fish | 340/274 X |
| 3,643,249 | 2/1972 | Haywood | 200/61.64 X |
| 3,735,613 | 5/1973 | Diebel et al. | 200/61.64 X |

*Primary Examiner*—James R. Scott
*Attorney, Agent, or Firm*—Lothrop & West

[57] ABSTRACT

A door lock condition indicator includes a lock frame adapted to be mounted on a door panel. Outer and inner spindles carrying knobs and rotatable about an axis are mounted on the lock frame to actuate a lock mechanism. A locking bar is disposed partly in the lock frame and partly in the inner spindle and is movable parallel to the axis between one position in engagement with the lock frame and free of the outer spindle and another position in engagement with the lock frame and engaging the outer spindle to prevent the lock mechanism from being actuated thereby. There is an electric switch included in an indicator circuit and disposed on the lock frame in a position to be engaged by the locking bar and actuated to close the circuit when the locking bar is in a selected one of the positions.

4 Claims, 4 Drawing Figures

ELECTRIC SWITCH CONTAINED WITHIN LOCK FRAME AND ACTUATED BY MOVEMENT OF LOCKING BAR

There are various indicator devices utilized in connection with doors; for example, as shown in Walter R. Schlage U.S. Pat. No. 2,266,086. Devices of this sort afford an indication of the condition of the lock to the extent that when an inner button is pressed to prevent rotation of an outer knob, a latch bolt or lock bolt switch in the strike or door frame is closed to activate the indicator. Another example is U.S. Pat. No. 3,514,557 to E. Jette, Jr. in which the latch bolt, when projected closes an indicator switch in the strike box. A difficulty is that some of this mechanism is in the strike box in the door frame and can be tampered with when the door is open. The switch cannot easily be actuated when the door is open under conditions of duress. A fairly close coordination of door position and jamb (door gap) is necessary to insure consistent operation.

It is therefore an object of my invention to provide means for indicating whether a bolt-actuating knob in a lock is held against rotation or is freely rotatable.

Another object of the invention is to provide a door lock condition indicator which is not contingent for its indication upon mechanism in the strike box.

A further object of the invention is to provide a door lock condition indicator that can readily be applied to locks already in existence, and which can afford an immediate or remote indication of their condition.

Another object of the invention is to provide a door lock condition indicator that can be entirely incorporated in the operating part of lock sets without any change in the accompanying strike structure.

A further object of the invention is to provide a door lock condition indicator that can actuate an alarm whether the door is open or closed.

Other objects of the invention, together with the foregoing, are attained in the embodiments of the invention described in the accompanying description and illustrated in the accompanying drawings, in which.

Figure 1:
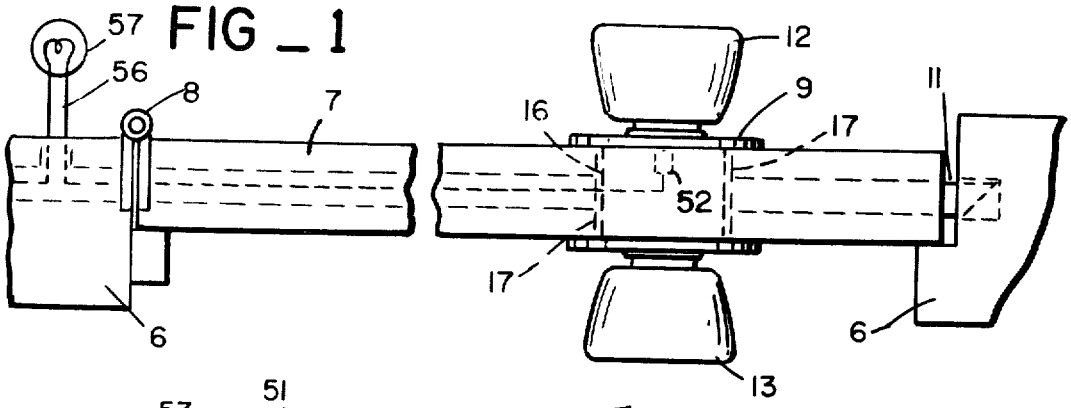
FIG. 1 is a diagram showing a typical installation of a door lock condition indicator pursuant to the invention in a hinge-mounted door panel movable with respect to a door frame.

In a typical installation, the environment includes a door frame 6, to which a door panel 7 is connected by hinges 8, so that the door panel can swing into and out of the door frame in the customary fashion. Mounted in the door panel is a lock mechanism 9 of the customary kind having a latch bolt 11 which can be withdrawn by appropriate rotation of an outer knob 12 and also by appropriate rotation of an inner knob 13.

The lock mechanism includes a lock frame 16 disposed in a through bore 17 in the door panel 7 and having an interior frame plate 18 removably secured to the frame 16. The lock frame further includes an inner hub 19 and an outer hub 21, both concentric with a rotational axis 22 normal to the general plane of the door panel 7. The detailed lock mechanism is not illustrated because it is of a well known nature; for example, of the type shown in Walter R. Schlage U.S. Pat. No. 1,579,457. Actuation of the bolt 11 is readily accomplished by rotation of the outer knob 12, the motion of which is transmitted by concurrent rotation of an outer spindle 23 journalled in the hub 21 concentric with the axis 22. Similarly, the bolt is also actuated by rotation of the inner knob 13 transmitting its motion through an inner spindle 24 journalled in the hub 19 and likewise concentric with the axis 22.

In accordance with one preferred construction, a locking bar 26 is provided for movement parallel to the axis 22 and partly housed within the frame 16 and partly within the inner spindle 24. The bar 26 is a flat strap at one end having an offset portion 27 and a pair of end dogs 28 and 29. The other end of the locking bar 26 is formed with an enlargement 31 over which is fitted a button 32 disposed for sliding or axial movement within the knob 13, and readily accessible to a person on the interior of the door. A spring 33 at one end abuts the enlargement 31 and at the other end is suitably stopped (through intermediate mechanism) by intrusions 34 in the wall of the inner spindle 24. The locking bar 26 is urged to the right in FIG. 2 and normally is in an extreme position with the button 32 projected. In this extreme, unlocked position of the bar 26 the locking dog 28 is disposed within a radial notch 36 in the frame plate 18. Because of this interengagement the locking bar 26 is movable axially of the frame but is not rotatable. When the button 32 and the bar 26 are translated to the left in FIG. 2, not only is the restoring spring 33 compressed, but likewise the locking dog 28 is moved axially within its notch 36. The bar 26 is translated far enough so that the dog 29 enters into and engages with the walls of a radial notch 37 in the outer spindle 23 to which the outer knob 12 is secured. In this second, locked position of the locking bar, the dog 28 is in engagement with the stationary frame 18, and the dog 29 is in engagement with the notch 37 in the spindle. The outer knob is thus dogged or is non-rotatable about the axis 22. The lock is thus in locked condition as to the outside knob.

Figure 2:
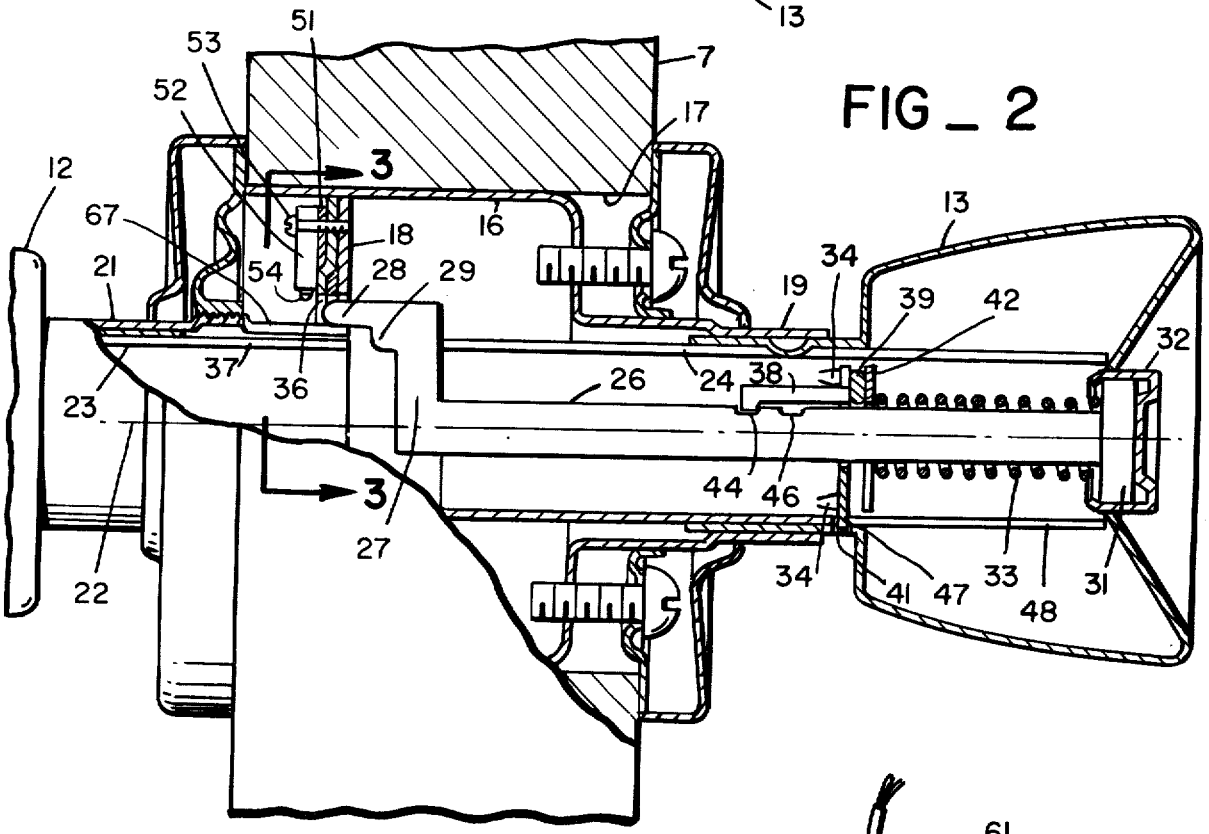
FIG. 2 is a cross-section on an axial plane showing a portion of a door panel in which a lock mechanism is mounted and in which parts of a door lock condition indicator are embodied.
Figure 3:
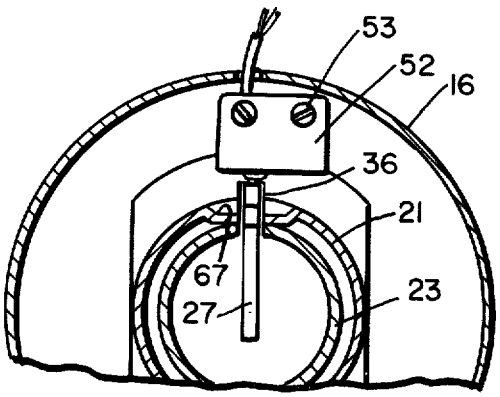
FIG. 3 is a cross-section, the plane of which is indicated by the line 3—3 of FIG. 2.

When the button 32 is depressed and the locking bar is translated to the left in FIG. 2, the locking bar underrides a bar-like latch lever 38 extending centrally within the spindle 24. The lever 38 has an enlarged transverse head 39, pressed toward abutment with a centrally circular, radially slotted washer 41 resting against the stops 34. Force is transmitted by a slotted washer 42 against which the spring 33 abuts. As the locking bar is translated, the lever 38 is rocked clockwise and is cammed out of one notch 44 in the locking bar and then snaps into a second notch 46 in the locking bar. In this way the button 32 is held depressed and the lock is held in locked condition. However, when the knob 13 is rotated in either direction the inner spindle 24 is similarly rotated. The washer 41 is concurrently rotated since it has a lug 47 thereon riding in an axial slot 48 in the inner spindle. The washer 41 thus rotates the lever 38 about the axis 22 in the direction the knob is turned, but the locking bar 26 is not rotated since it passes freely through the slotted washer 41 and in addition is held at the end against rotation by the radial notches 36 and 37. Since the locking bar is a flat strap the bodily rotation of the lever 38 with the spindle to either side of center releases the locking bar. This then, under the influence of the spring 33, moves axially to the right, in doing so passing the end of the lever 38.

When the knob 13 is rotated back to its central position, the lever 38 again resumes its position in the notch 44. In this way the locking bar is effective to hold the lock set in locked condition or to release it to unlocked condition.

Particularly pursuant to the present invention there is mounted on the frame plate 18, preferably with an intervening spacer 51, a microswitch 52 secured in position by one or more screws 53. The microswitch includes an actuator 54 which is spring-pressed and normally projects to leave the switch in one condition whereas when the actuator 54 is depressed the switch is then in the opposite condition. The mounting is such that the actuator 54 is directly in the path of the lug or dog 28. When the locking bar is in the unlocked position as shown in FIG. 2, the dog 28 is not in contact with the actuator 54 but when the locking bar is translated to the left into its other extreme, locked position, then the rounded end of the dog 28 cams against and depresses the actuator 54 and so changes the condition of the switch 52.

The switch 52, as shown diagrammatically in FIG. 1, is included in a circuit generally designated 56, having a suitable source of electromotive force (not shown) and also having an indicator 57. This can be a light, buzzer, or comparable device.

With this arrangement, whenever the lock is in unlocked condition and the outer knob 12 can be easily rotated, the indicator 57 is either de-energized or energized, depending on how the switch 52 is arranged. In the other condition, when the outer knob 12 cannot be rotated because the locking bar 26 has been displaced by depression of the button 32 so that the dogs 28 and 29 are in their respective notches 36 and 37, the switch actuator 54 is depressed, the switch is in an opposite condition and the indicator 57 is also in its alternate condition. In this way a switch can easily be arranged within a standard mechanism to actuate a remote indication of the locked condition of the lock set.

Figure 4:
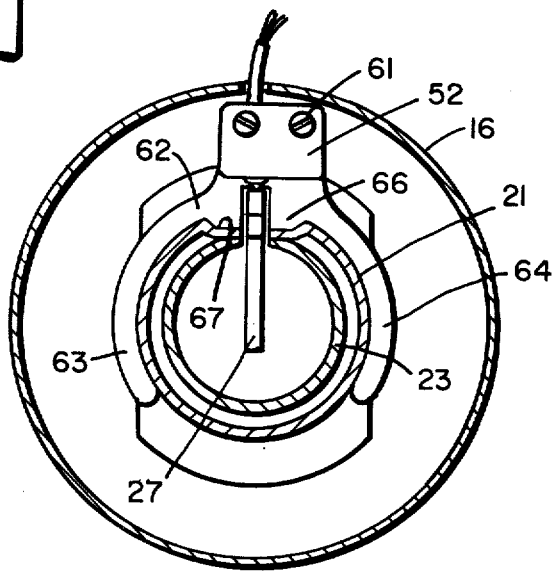
FIG. 4 is a view similar to FIG. 3, but showing a modified form of construction.

As particularly illustrated in FIG. 4, the switch 52 can be mounted releasably rather than fixedly on the frame 16. In this instance the switch 52 is directly held by fastenings 61 to a somewhat springy plastic clip 62. A pair of arms 63 and 64 on the clip can be sprung apart slightly to be moved radially over the outer hub 21 and then can be moved axially so that the switch 52 nests well within the protection of the outer frame 16. The clip is kept from rotating by an internally extending lug 66 which fits into a depressed pocket 67 normally provided in the hub. The pocket 67 is axially short so the lug 66 and clip 62 are also confined in an axial direction. In this way, the switch can be very easily applied to a pre-assembled lock or can be removed therefrom if its function is no longer required without in any way requiring any machine work or permanent attachment to the lock frame. There are usually several pre-existing notches or openings in the lock frame 16 so that the conductors in the circuit 56 can be appropriately and safely disposed.

With this arrangement, the switch device is entirely included with the door-mounted part of the lock set and can be actuated in any position of the door, whether open or closed provided the circuit 56 remains continuous where it crosses the gap between the door panel and the door frame. This is valuable in duress conditions. Should a person open a door, even a few inches, and be confronted by an intruder, he can depress the button 32 while his hand is still on the knob 13 and so give an immediate alarm.

Under other circumstances, if it is desired to indicate whether the door is open or closed in addition to showing whether or not the door is locked, the circuit 56 is arranged to be continuous only when the door is closed and to be broken by the opening of the door. In that case a door closed and lock indication can be given by closure of the switch 52.

What is claimed is:

1. A door lock condition indicator comprising a lock frame, an outer hub on said frame concentric with a rotational axis, an inner hub on said frame concentric with said axis, an outer spindle rotatable in said outer hub about said axis, an inner spindle rotatable in said inner hub about said axis, a locking bar, means for mounting said locking bar in said inner spindle for movement relative to said lock frame parallel to and along said axis between a first position in non-rotational engagement with said lock frame and free from said outer spindle and a second position in non-rotatable engagement with said lock frame and in non-rotatable engagement with said outer spindle, an electric switch having a radially movable actuator, and means for mounting said switch on said lock frame with said actuator in position radially and axially free of said locking bar in one of said locking bar positions and axially engaged and radially moved by said locking bar in the other of said locking bar positions.

2. A device as in claim 1 including a spring in said inner spindle urging said locking bar toward one of said locking bar positions.

3. A device as in claim 1 in which said actuator moves linearly, said mounting means supports said switch within said lock frame and outside said outer spindle and with said actuator movable radially, and said locking bar has an end dog axially movable with said locking bar and camming radially against said actuator.

4. A door lock condition indicator comprising a lock frame symmetrical about an axis, a hub secured to said lock frame and extending inside said lock frame along said axis, means on said hub forming a depressed pocket, an electric switch, a clip engaging said hub and supporting said electric switch within said lock frame, a lug on said clip adapted to seat in said pocket, and means within said lock frame and movable along said axis into and out of engagement with said electric switch.

* * * * *